US007744807B2

(12) United States Patent
Berrigan et al.

(10) Patent No.: US 7,744,807 B2
(45) Date of Patent: Jun. 29, 2010

(54) NONWOVEN ELASTIC FIBROUS WEBS AND METHODS FOR MAKING THEM

(75) Inventors: Michael R. Berrigan, Oakdale, MN (US); Anne N. De Rovere, Woodbury, MN (US); Bradley W. Eaton, Woodbury, MN (US); Brandy S. Nolan, Woodbury, MN (US); Troy K. Ista, River Falls, WI (US); Timothy J. Lindquist, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 153 days.

(21) Appl. No.: 11/462,817

(22) Filed: Aug. 7, 2006

(65) Prior Publication Data

US 2006/0266462 A1 Nov. 30, 2006

Related U.S. Application Data

(62) Division of application No. 10/715,315, filed on Nov. 17, 2003, now abandoned.

(51) Int. Cl.
*B28B 3/20* (2006.01)

(52) U.S. Cl. ..... 264/639; 264/638; 264/640; 264/653; 156/244.1; 156/244.24; 156/311

(58) Field of Classification Search ..... 156/244.11, 156/244.19, 244.24, 311; 264/638, 639, 264/640, 653

See application file for complete search history.

(56) References Cited

U.S. PATENT DOCUMENTS 3,686,385 A 8/1972 Rohn (Continued)

FOREIGN PATENT DOCUMENTS

EP 0 322 136 A2 12/1988

(Continued)

OTHER PUBLICATIONS

Encycloaedia Chimica 1, 14th Ed., published by Kyoritsu Shuppan Co., Ltd., 1963, p. 983.

(Continued)

*Primary Examiner*—Andrew T Piziali
(74) *Attorney, Agent, or Firm*—Roger R. Tamte; James A. Baker

(57) ABSTRACT

A coherent nonwoven fibrous web comprises directly formed elastic fibers that have a molecular orientation sufficient to provide a birefringence number of at least $1\times10^{-5}$ and preferably at least $1\times10^{-2}$. The web can be made by a method that comprises a) extruding filaments of elastic-fiber-forming material; b) directing the filaments through a processing chamber in which gaseous currents apply a longitudinal stress to the filaments that attenuates and draws the filaments; c) maintaining the filaments at their orienting temperature while the filaments are under attenuating and drawing stress for a sufficient time for molecules within the filaments to become oriented along the length of the filaments; d) cooling the filaments to their orientation-locking temperature while the filaments are under attenuating and drawing stress and further cooling the filaments to a solidified fiber form; and e) collecting the solidified fibers as a fibrous nonwoven web. In a preferred aspect, the method includes the further step of annealing the collected fibers by exposing them to a temperature that is above their shrinking temperature but less than their relaxation temperature, and preferably bonding the fibers after (or before) the annealing step. Dimensionally stable webs comprising elastic oriented fibers are obtained.

20 Claims, 6 Drawing Sheets

U.S. PATENT DOCUMENTS

| | | | | |
|---|---|---|---|---|
| 3,783,649 | A | | 1/1974 | Yamamoto et al. |
| 3,855,045 | A | | 12/1974 | Brock |
| 3,959,421 | A | * | 5/1976 | Weber et al. ..... 264/6 |
| 3,971,373 | A | | 7/1976 | Braun |
| 4,086,381 | A | | 4/1978 | Cheshire et al. |
| 4,118,531 | A | | 10/1978 | Hauser |
| 4,147,749 | A | | 4/1979 | Lipscomb et al. |
| 4,163,819 | A | | 8/1979 | Yung et al. |
| 4,164,600 | A | * | 8/1979 | Yung et al. ..... 428/198 |
| 4,189,338 | A | | 2/1980 | Ejima et al. |
| 4,405,297 | A | | 9/1983 | Appel et al. |
| 4,692,371 | A | | 9/1987 | Morman et al. |
| 4,707,398 | A | | 11/1987 | Boggs |
| 4,813,948 | A | | 3/1989 | Insley |
| 4,820,572 | A | | 4/1989 | Killian et al. |
| 4,891,957 | A | | 1/1990 | Strack et al. |
| 5,296,286 | A | | 3/1994 | Allen et al. |
| 5,322,728 | A | | 6/1994 | Davey et al. |
| 5,366,793 | A | | 11/1994 | Fitts, Jr. et al. |
| 5,389,202 | A | | 2/1995 | Everhart et al. |
| 5,460,500 | A | | 10/1995 | Geus et al. |
| 5,470,639 | A | | 11/1995 | Gessner et al. |
| 5,613,986 | A | * | 3/1997 | Bessey et al. ..... 8/489 |
| 5,635,290 | A | | 6/1997 | Stopper et al. |
| 5,652,051 | A | | 7/1997 | Shawver et al. |
| 5,714,107 | A | | 2/1998 | Levy et al. |
| 5,997,989 | A | | 12/1999 | Gessner et al. |
| 6,165,217 | A | | 12/2000 | Hayes |
| 6,183,684 | B1 | | 2/2001 | Lu |
| 6,274,238 | B1 | | 8/2001 | DeLucia |
| 6,607,624 | B2 | | 8/2003 | Berrigan et al. |
| 2002/0102897 | A1 | | 8/2002 | Berrigan et al. |
| 2003/0216096 | A1 | | 11/2003 | Berrigan et al. |
| 2003/0216099 | A1 | | 11/2003 | Berrigan et al. |

FOREIGN PATENT DOCUMENTS

| | | | |
|---|---|---|---|
| EP | 0 725 174 | A1 | 1/1996 |
| EP | 1 101 854 | A1 | 11/2000 |
| JP | 9-500936 | | 1/1997 |
| JP | 9-31819 | | 2/1997 |
| JP | 2002-242069 | | 8/2002 |
| WO | WO 95/04182 | | 2/1995 |
| WO | WO 02/055782 | | 7/2002 |

OTHER PUBLICATIONS

Introduction to High-Order Structural Analysis of Plastic Molded Products, 1st Ed., Feb. 28, 2006, publisher: Nikkan Kogyo Newspaper Co., pp. 54-55.

Awaya, Introduction to Polarizing Microscope for Polymer Materials, 1st Ed., Oct. 15, 2001, published by Agnes Technology Center, p. 102.

* cited by examiner

NONWOVEN ELASTIC FIBROUS WEBS AND METHODS FOR MAKING THEM

RELATED APPLICATION DATA

This application is a divisional of application Ser. No. 10/715,315, filed Nov. 17, 2003, now abandoned.

FIELD OF THE INVENTION

This invention relates to nonwoven fibrous webs that comprise elastic fibers, whereby the web as a whole can have elastic properties.

BACKGROUND

Important commercial opportunities await nonwoven fibrous webs that are suitably stretchable, elastic and strong. Such webs could be useful to make a garment form-fitting, or to make a cuff, neck-line or other portion of a garment elastically retain its shape. Or such webs could provide breathable, soft, lightweight, cloth-like fabrics. Also, such webs tend to be of high friction, which can be useful in a number of applications.

Recognizing the opportunities, many prior workers have sought to produce elastic nonwoven fibrous webs. Their prior work is represented in the patent literature, which includes U.S. Pat. Nos. 3,686,385; 4,707,398; 4,820,572; 4,891,957; 5,322,728; 5,366,793; 5,470,639; and 5,997,989.

While the prior work may have met some needs, many opportunities remain unsatisfied. In general, the prior efforts have not produced a fibrous web having an adequate combination of stretchability, elasticity, bondability and strength to fulfill many of the visualized opportunities.

SUMMARY

The present invention provides a fibrous elastic nonwoven web that comprises directly collected elastic fibers that are oriented, thereby providing the fibers and the web with beneficial and superior strength properties.

By "directly formed fibers" it is meant fibers formed and collected as a fibrous nonwoven web in essentially one operation, e.g., by extruding filaments from a fiber-forming liquid, processing the extruded filaments to a solidified fiber form as they travel to a collector, and collecting the processed fibers as a web within seconds after the fibers left the liquid form. Such a method is in contrast with methods in which, for example, extruded fibers are chopped into staple fibers before they are assembled into a web. Meltblown fibers and meltspun fibers, including spunbond fibers and fibers prepared and collected in webs in the manner described in U.S. Pat. No. 6,607,624, are examples of directly formed fibers useful for the present invention.

By "oriented" it is meant that portions of polymer molecules within the fibers are aligned lengthwise of the fibers, and are locked in, i.e., are thermally fixed or trapped in, that alignment. In other words, for the molecules to move out of their orienting alignment would require the fibers to be heated above the relaxation temperature for the fibers for sufficient time that the molecules would be free to move and rearrange themselves sufficiently to lose their orientation ["relaxation temperature" is defined herein as a temperature that is within plus or minus 5° C. of the glass transition temperature (for amorphous noncrystalline materials) or melting temperature (for crystalline or semicrystalline materials)]. The aligned molecules can improve strength properties of the fibers.

Whether molecules are oriented within a fiber can generally be indicated by measuring whether the fibers exhibit birefringence. If fibers exhibit a birefringence number of at least about $1\times10^{-5}$ by the test described herein, they are regarded as oriented. The higher the birefringence number, the higher the degree of orientation, and preferably fibers in webs of the invention exhibit a birefringence number of at least $1\times10^{-4}$ or at least $1\times10^{-3}$; and with certain polymers we have successfully prepared fibers with birefringence numbers of $1-10^{-2}$ or more. Fibers of different polymer classes may show different degrees of orientation and different levels of birefringence number.

The directly formed oriented fibers can have varying degrees of elasticity, but preferably they are "elastomeric" fibers. The term "elastomeric fibers" is regarded herein as meaning fibers that may be stretched to at least twice their original length and, when released from tension stretching them to twice their original length, will promptly retract to no more than one-and-one-fourth times their original length. Elastomeric fibers are especially needed for certain uses, and oriented elastomeric fibers make distinct contributions that elastic fibers of less stretchability or less elastic recovery cannot make. The term "elastic fibers" is regarded herein as describing a larger category of fibers, including fibers of a lesser stretchability, but which elastically recover at least partially from their stretched dimensions. An elastic fiber generally is regarded herein as one that may be stretched to at least 125 percent of its original length before breaking, and upon release of tension from such a degree of stretch will retract at least 50% of the amount of elongation.

Though having oriented fibers, webs of the invention can be, and preferably are, dimensionally stable. By "dimensionally stable" it is meant that the web will shrink in its width dimension (transverse to the machine direction, i.e., the direction of movement of a collector on which the web was collected) by no more than about 10 percent when heated to a temperature of 70° C. We have found that webs can be annealed to release strains that would otherwise cause the web to shrink upon heating, and despite the annealing the fibers can have a retained orientation that provides improved properties.

The present invention also provides a new method for making elastic fibers and webs of the invention, which in brief summary, comprises a) extruding filaments of elastic-fiber-forming material; b) directing the filaments through a processing chamber in which a longitudinal stress is applied to the filaments that attenuates and draws the filaments; c) maintaining the filaments at their orienting temperature while the filaments are under attenuating and drawing stress for a sufficient time for molecules within the filaments to become oriented and aligned along the length of the filaments; d) cooling the filaments to their orientation-locking temperature while the filaments are under the attenuating and drawing stress; and e) collecting the processed filaments.

By "orienting temperature" is meant a temperature at which molecules within the extruded filaments can move into alignment lengthwise of the filaments under attenuation or drawing stress; such a temperature is generally at least about or greater than the glass transition ($T_g$) or melting point ($T_m$) for the filaments. By "orientation-locking temperature" is meant a temperature at which the molecules of the filaments become thermally fixed or trapped into an orientation they may have attained within the filament. Such a temperature is generally at least about 30° C. less than the relaxation temperature for the filaments.

In another aspect of the invention, a method as described includes the further step of annealing the prepared fibers by exposing them to a temperature that is at or above the shrinking temperature of the fibers but at least 10° C. less than the relaxation temperature of the fibers. ("Shrinking temperature" means herein a temperature at which fibers release strain by shrinking more than 10%, but which is less than the melting or softening temperature of the fibers.) We have found that during such a step preferred fibers prepared according to the invention can undergo shrinkage while maintaining some useful molecular orientation. And the elastic properties of the fibers and webs, especially the amount of their stretchability, can be increased by annealing and by shrinkage that occurs with annealing.

DETAILED DESCRIPTION

Figure 1:
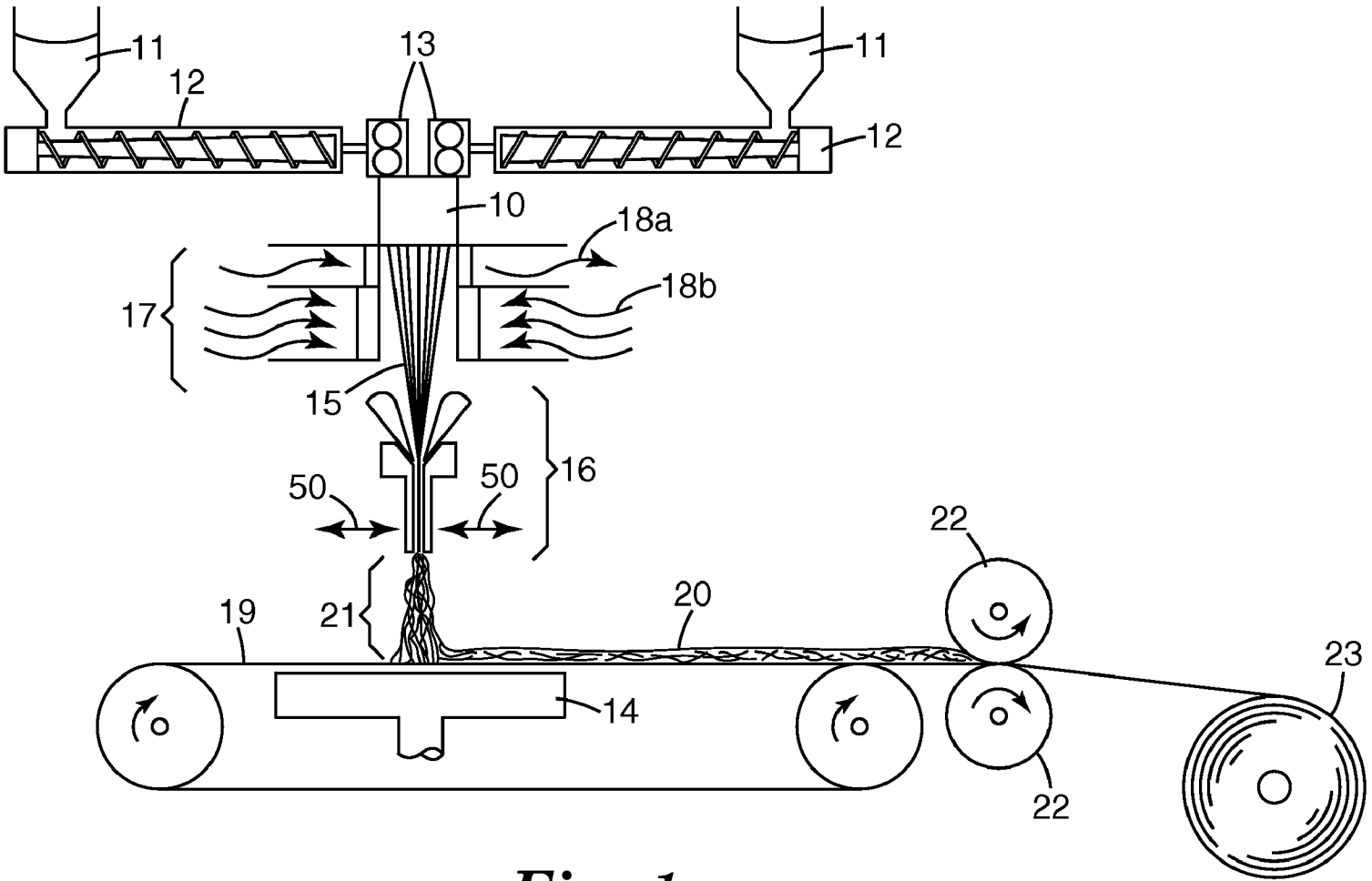
FIG. 1 is a schematic overall diagram of apparatus useful for forming a nonwoven fibrous web of the invention.

FIG. 1 shows an illustrative apparatus that can be used to prepare nonwoven fibrous webs of the invention. Fiber-forming material is brought to an extrusion head 10—in this particular illustrative apparatus, by introducing a fiber-forming material into hoppers 11, melting the material in an extruder 12, and pumping the molten material into the extrusion head 10 through a pump 13. Although solid polymeric material in pellet or other particulate form is most commonly used and melted to a liquid, pumpable state, other fiber-forming liquids such as polymer solutions could also be used.

The extrusion head 10 may be a conventional spinnerette or spin pack, generally including multiple orifices arranged in a regular pattern, e.g., straightline rows. Filaments 15 of fiber-forming liquid are extruded from the extrusion head and conveyed to a processing chamber or attenuator 16. Typically, some quenching streams of air or other gas 18 are presented to the extruded filaments by conventional methods and apparatus to reduce the temperature of the extruded filaments 15. Sometimes the quenching streams may be heated to obtain a desired temperature of the extruded filaments and/or to facilitate drawing of the filaments. There may be one or more streams of air (or other fluid)—e.g., a first stream 18*a* blown transversely to the filament stream, which may remove undesired gaseous materials or fumes released during extrusion; and a second quenching stream 18*b* that achieves a major desired temperature reduction. Depending on the process being used or the form of finished product desired, the quenching stream may be sufficient to solidify some of the extruded filaments 15 before they reach the attenuator 16. But in general, in a method of the invention extruded filamentary components are still in a softened or molten condition when they enter the attenuator. Alternatively, no quenching streams are used; in such a case ambient air or other fluid between the extrusion head 10 and the attenuator 16 may be a medium for any temperature change in the extruded filamentary components before they enter the attenuator.

The filaments 15 pass through the attenuator 16, as discussed in more detail below, and then exit. Most often, as pictured in FIG. 1, they exit onto a collector 19 where they are collected as a mass of fibers 20 that may or may not be coherent and take the form of a handleable web. The collector 19 is generally porous and a gas-withdrawal device 14 can be positioned below the collector to assist deposition of fibers onto the collector.

Depending on the chemical composition of the filaments, different kinds of morphology can be obtained in a fiber. As discussed below, the possible morphological forms within a fiber include amorphous, ordered or rigid amorphous, oriented amorphous, crystalline, oriented or shaped crystalline, and extended-chain crystallization (sometimes called strain-induced crystallization). Fibers in webs of the invention can exhibit more than one of these different kinds of morphology. Also, in some embodiments the different kinds of morphology can exist within the same fiber, e.g., can exist along the length of a single fiber, or can exist in different amounts or at different degrees of order or orientation. And these differences can exist to the extent that longitudinal segments along the length of the fiber differ in softening characteristics during a bonding operation.

After passing through a processing chamber, but prior to collection, extruded filaments or fibers may be subjected to a number of additional processing steps not illustrated in FIG. 1, e.g., further drawing, spraying, etc. Upon collection, the whole mass 20 of collected fibers may be conveyed to other apparatus such as a bonding oven, through-air bonder, calenders, hydroentangling mechanical bonder, embossing stations, laminators, cutters and the like; or it may be passed through drive rolls 22 and wound into a storage roll 23.

In one preferred practice of the invention the collected fibers are exposed to heat, e.g., by passage through an oven or past a "through-air" oven, or hot-air knife, to anneal the fibers. That is, tensions or other stresses within the fibers are reduced or removed, whereupon the fibers have improved stability under certain environmental conditions. As discussed above, it has been found that when elastic fibers oriented according to the invention are heated to a temperature above the shrinking temperature but less than the relaxation temperature the fibers undergo shrinking and lose some orientation, but not all their orientation. Preferred fibers of the invention generally retain some orientation after annealing, which improves the physical properties of the fibers. The amount of orientation retained generally can be controlled at least partially by the length of heat exposure and the temperature to which the fibers are exposed.

The described step of annealing can be beneficial as preparation for bonding of the collected fibers, if bonding has not already been achieved during collection. If certain collected masses of fibers of the invention are thermally bonded without first annealing, the collected mass may shrink during the bonding operation to form a distorted web shrunk in an uncontrolled manner. But it has been found in preferred embodiments that, after a controlled annealing as discussed above, bonding can be achieved while leaving the web in a usefully undistorted state, and with the fibers retaining a beneficial, fiber-strengthening orientation.

When annealing and bonding are used, the bonding can be performed immediately following annealing. For example, thermal bonding can be performed in the same oven where annealing was performed, or in an adjacent oven, heated to a higher temperature than used in the annealing operation. Or bonding can be performed by conveying the web to a through-air bonder, or a calendering or point-bonding apparatus. Bonding need not be performed immediately after annealing, and it may be desirable to wait a period of time such as 36-48 hours after annealing for the fibers, during which time the fibers may further relax. Preferably thermal bonds are autogenous bonds, meaning formed without pressure such as applied by a calender or point-bonder. Bonding also can be achieved by inclusion of bonding fibers or resins in a web, or by application of solvents to the web, or to points or portions of the web.

The apparatus pictured in FIG. 1 is of advantage in practicing the invention because it allows control over the temperature of filaments passing through the attenuator, allows filaments to pass through the chamber at fast rates, and can apply stresses on the filaments that introduce desired degrees of orientation on the filaments. (Apparatus as shown in the drawings has also been described in U.S. Pat. No. 6,607,624, issued Aug. 19, 2003, which is incorporated by reference in the present application.) As part of a desired control of the process, the distance 17 the extruded filaments 15 travel before reaching the attenuator 16 can be adjusted, as can the conditions to which the filaments are exposed. For example, the processing chamber can be moved closer to the extrusion head to cause the extruded filaments to be higher in temperature when they enter the processing chamber than they otherwise would be. When such higher-temperature filaments are subjected to tension in the processing chamber, they may more easily stretch, and molecules within the filaments may become aligned or oriented.

In general, the temperature of the filaments entering the processing chamber, and the tension applied to the filaments in the processing chamber are chosen to achieve desired and effective (i.e., non-rupturing) degrees of stretch in the extruded filaments as they travel through the processing chamber. In contrast to typical prior art spunbond processes and equipment, the present invention provides new methods that can include, among other things, application of drawing/attenuating stress while the extruded filament is still sufficiently elevated in temperature to be at orienting temperature as defined herein; application of drawing/attenuating stress for relatively longer times (i.e., for a greater proportion of their time in the threadline); and application of drawing/attenuating stress until the extruded filament has cooled below its orientation-locking temperature. In the present invention the threadline stress can be held to a lower level than typically used in the spunbond process so as to avoid rupturing even of filaments that are above their glass transition temperature or melting point. In fact, the intentional application of attenuating stress while filaments are above their glass transition or melting point contributes to the ability to use low stress. And filaments can be moved through the processing chamber at fast rates that minimize the opportunity for oriented molecules within a filament to retract to a nonoriented condition (i.e., not aligned lengthwise of the filament) before the filament cools to the orientation-locking temperature.

As stated above, the filaments should generally be above their orienting temperature during at least part of the time they are under longitudinal stress. The useful orienting temperature varies depending on the polymer family, but in general it is a temperature at least 20° C. and preferably at least 40° C. above the relaxation temperature for the filaments.

As the filaments proceed through the processing chamber and to the collector they cool, and eventually they reach the orientation-locking temperature. Again, this temperature will vary for different polymer families, but typically it is a temperature at least 30° C. less, and preferably at least 80° C. less than the relaxation temperature. When the filaments reach the orientation-locking temperature they are under longitudinal stress, which in general has been applied long enough that molecules within the filaments have become aligned lengthwise of the filaments. Lower stresses than would be applied to filaments that have cooled and are undergoing cold-draw can be applied to the still-hot filaments of a method of the invention, and those stresses can be applied for longer times than is typical in the prior art processes. As a corollary, a larger extent of orientation can be introduced into the filaments before the filaments reach the orientation-locking temperature.

Because the filaments have orientation and are under longitudinal tension when they cool to the orientation-locking temperature, the orientation is retained at least in part in the collected fibers. Sufficient of such retained orientation is present that, even though later annealing may cause some loss of orientation, orientation can remain after annealing to enhance strength and stability of the fibers.

Other useful controls of the process can generally be achieved by controlling the length of the processing chamber/attenuator, the velocity and temperature of the filaments as they move through the attenuator, and the distance of the attenuator from the collector 19. By causing some or all of the filaments and segments thereof to cool to a solid condition while under tension and in a stretched condition, the orientation of the filaments, and the consequent morphology of the fibers, can become frozen in; i.e., molecules or portions thereof in the filaments or fibers can be thermally fixed or trapped in their aligned position, as discussed above.

Figure 2:
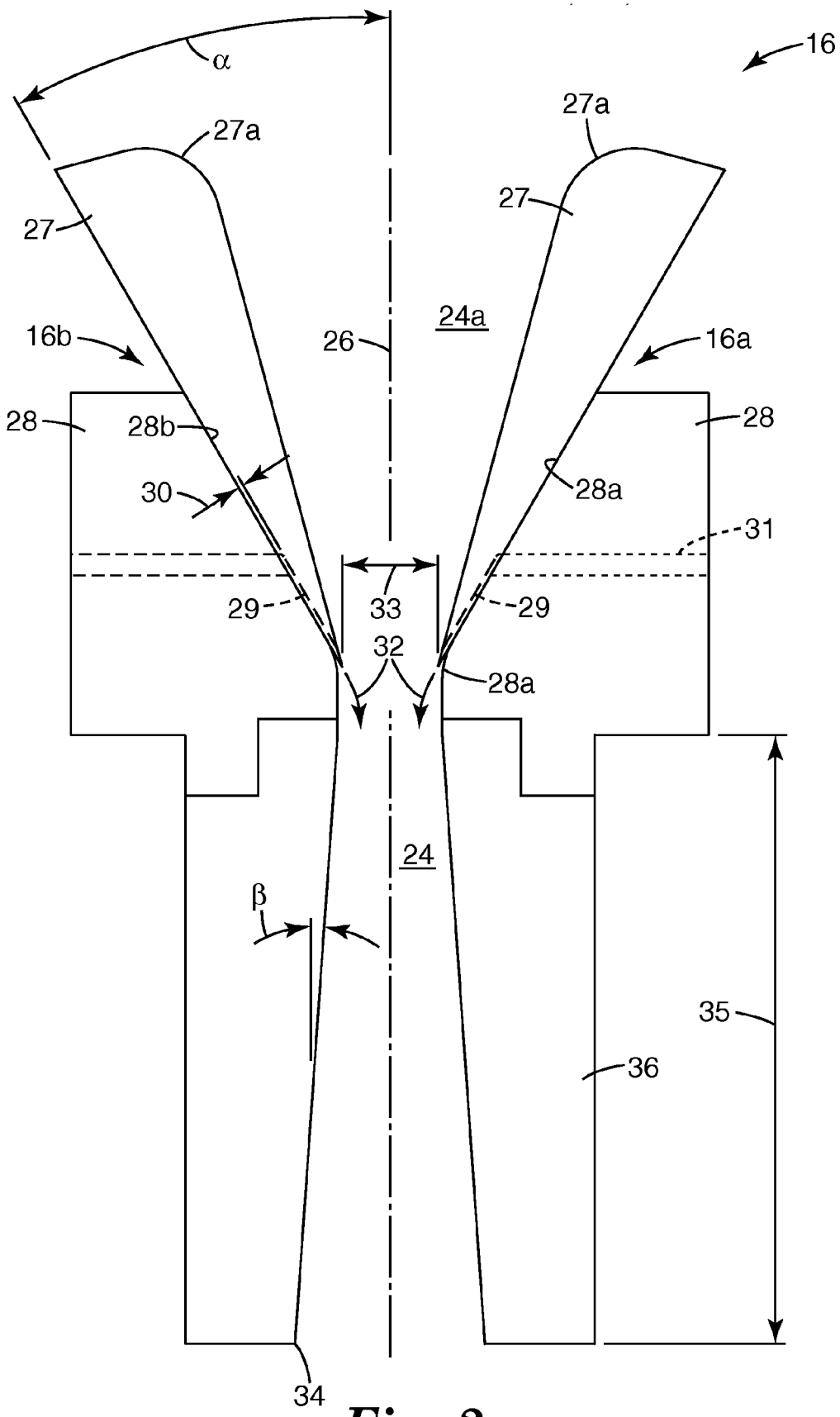
FIG. 2 is an enlarged side view of a processing chamber useful for forming a nonwoven fibrous web of the invention, with mounting means for the chamber not shown.
Figure 3:
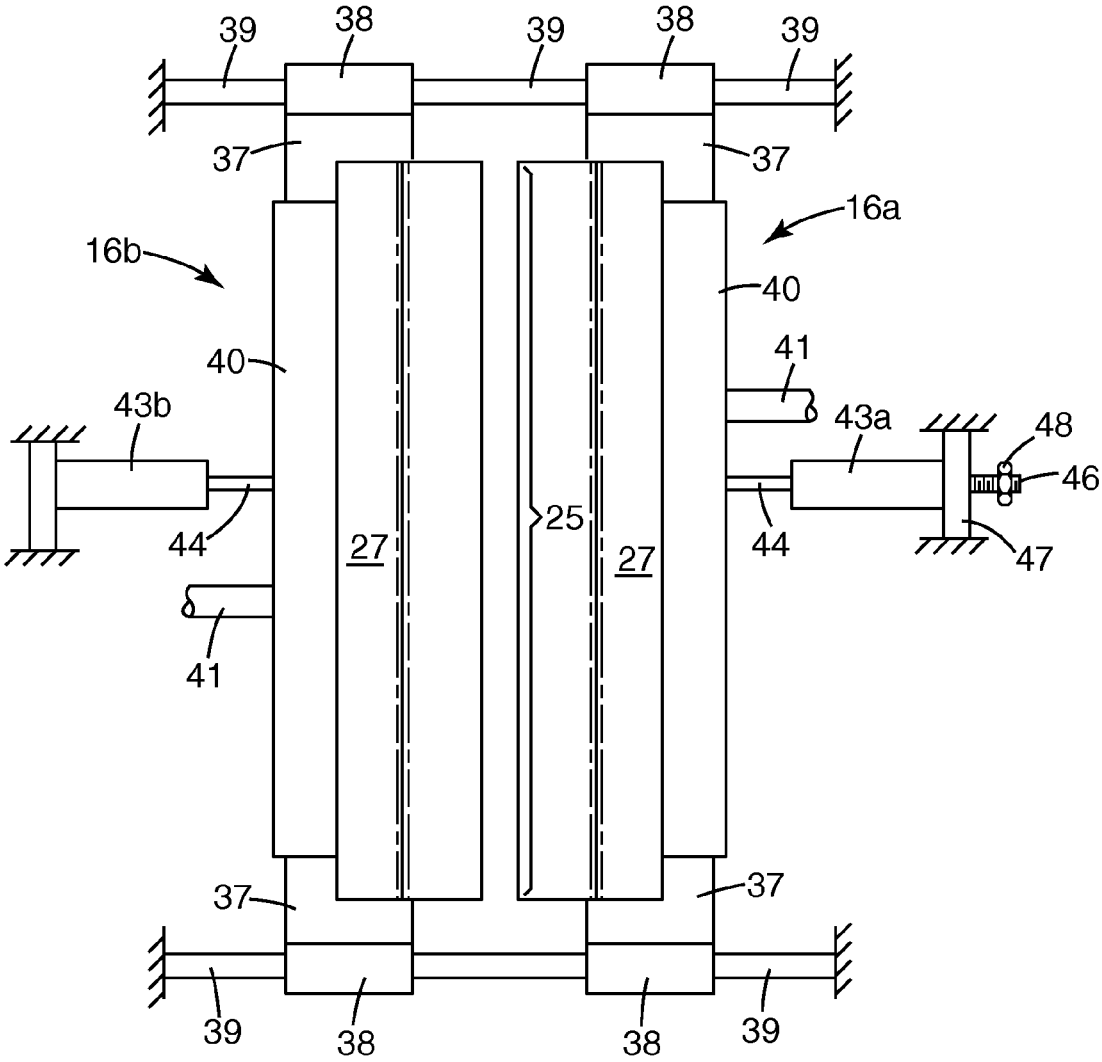
FIG. 3 is a top view, partially schematic, of the processing chamber shown in FIG. 2 together with mounting and other associated apparatus.

Some advantageous features of the apparatus are further shown in FIG. 2, which is an enlarged side view of a representative processing device or attenuator, and FIG. 3, which is a top view, partially schematic, of the processing apparatus shown in FIG. 2 together with mounting and other associated apparatus. The illustrative attenuator 16 comprises two movable halves or sides 16*a* and 16*b* separated so as to define between them the processing chamber 24: the facing surfaces of the sides 16*a* and 16*b* form the walls of the chamber. As seen from the top view in FIG. 3, the processing or attenuation chamber 24 is generally an elongated slot, having a transverse length 25 (transverse to the path of travel of filaments through the attenuator), which can vary depending on the number of filaments being processed.

Although existing as two halves or sides, the attenuator functions as one unitary device and will be first discussed in its combined form. (The structure shown in FIGS. 2 and 3 is representative only, and a variety of different constructions may be used.) The representative attenuator 16 includes slanted entry walls 27, which define an entrance space or throat 24*a* of the attenuation chamber 24. The entry walls 27 preferably are curved at the entry edge or surface 27*a* to smooth the entry of air streams carrying the extruded filaments 15. The walls 27 are attached to a main body portion 28, and may be provided with a recessed area 29 to establish a gap 30 between the body portion 28 and wall 27. Air may be introduced into the gaps 30 through conduits 31, creating air knives (represented by the arrows 32) that increase the velocity of the filaments traveling through the attenuator, and that also have a further quenching affect on the filaments. The attenuator body 28 is preferably curved at 28*a* to smooth the passage of air from the air knife 32 into the passage 24. The angle ($\alpha$) of the surface 28*b* of the attenuator body can be selected to determine the desired angle at which the air knife impacts a stream of filaments passing through the attenuator. Instead of being near the entry to the chamber, the air knives may be disposed further within the chamber.

The attenuation chamber 24 may have a uniform gap width (the horizontal distance 33 on the page of FIG. 2 between the two attenuator sides is herein called the gap width) over its longitudinal length through the attenuator (the dimension along a longitudinal axis 26 through the attenuation chamber is called the axial length). Alternatively, as illustrated in FIG. 2, the gap width may vary along the length of the attenuator chamber. When the attenuation chamber is defined by straight or flat walls, the spacing between the walls may be constant over their length, or alternatively the walls may slightly diverge or converge over the axial length of the attenuation chamber. In all these cases, the walls defining the attenuation chamber are regarded as parallel herein, because the deviation from exact parallelism is relatively slight. As illustrated in FIG. 2, the walls defining the main portion of the longitudinal length of the passage 24 may take the form of plates 36 that are separate from, and attached to, the main body portion 28.

The length of the attenuation chamber 24 can be varied to achieve different effects; variation is especially useful with the portion between the air knives 32 and the exit opening 34, sometimes called herein the chute length 35. The angle between the chamber walls and the axis 26 may be wider near the exit 34 to change the distribution of fibers onto the collector as well as to change the turbulence and patterns of the current field at the exit of the attenuator. Structure such as deflector surfaces, Coanda curved surfaces, and uneven wall lengths also may be used at the exit to achieve a desired current force-field as well as spreading or other distribution of fibers. In general, the gap width, chute length, attenuation chamber shape, etc. are chosen in conjunction with the material being processed and the mode of treatment desired to achieve desired effects. For example, longer chute lengths may be useful to increase the crystallinity of prepared fibers. Conditions are chosen and can be widely varied to process the extruded filaments into a desired fiber form.

As illustrated in FIG. 3, the two sides 16*a* and 16*b* of the representative attenuator 16 are each supported through mounting blocks 37 attached to linear bearings 38 that slide on rods 39. The bearing 38 has a low-friction travel on the rod through means such as axially extending rows of ball-bearings disposed radially around the rod, whereby the sides 16*a* and 16*b* can readily move toward and away from one another. The mounting blocks 37 are attached to the attenuator body 28 and a housing 40 through which air from a supply pipe 41 is distributed to the conduits 31 and air knives 32.

In this illustrative embodiment, air cylinders 43*a* and 43*b* are connected, respectively, to the attenuator sides 16*a* and 16*b* through connecting rods 44 and apply a clamping force pressing the attenuator sides 16*a* and 16*b* toward one another. The clamping force is chosen in conjunction with the other operating parameters so as to balance the pressure existing within the attenuation chamber 24. In other words, under preferred operating conditions the clamping force is in balance or equilibrium with the force acting internally within the attenuation chamber to press the attenuator sides apart, e.g., the force created by the gaseous pressure within the attenuator. Filamentary material can be extruded, passed through the attenuator and collected as finished fibers while the attenuator parts remain in their established equilibrium or steady-state position and the attenuation chamber or passage 24 remains at its established equilibrium or steady-state gap width.

During operation of the representative apparatus illustrated in FIGS. 1-3, movement of the attenuator sides or chamber walls generally occurs only when there is a perturbation of the system. Such a perturbation may occur when a filament being processed breaks or tangles with another filament or fiber. Such breaks or tangles are often accompanied by an increase in pressure within the attenuation chamber 24, e.g., because the forward end of the filament coming from the extrusion head or the tangle is enlarged and creates a localized blockage of the chamber 24. The increased pressure can be sufficient to force the attenuator sides or chamber walls 16*a* and 16*b* to move away from one another. Upon this movement of the chamber walls the end of the incoming filament or the tangle can pass through the attenuator, whereupon the pressure in the attenuation chamber 24 returns to its steady-state value before the perturbation, and the clamping pressure exerted by the air cylinders 43 returns the attenuator sides to their steady-state position. Other perturbations causing an increase in pressure in the attenuation chamber include "drips," i.e., globular liquid pieces of fiber-forming material falling from the exit of the extrusion head upon interruption of an extruded filament, or accumulations of extruded filamentary material that may engage and stick to the walls of the attenuation chamber or to previously deposited fiber-forming material.

In effect, one or both of the attenuator sides 16*a* and 16*b* "float," i.e., are not held in place by any structure but instead are mounted for a free and easy movement laterally in the direction of the arrows 50 in FIG. 1. In a preferred arrangement, the only forces acting on the attenuator sides other than friction and gravity are the biasing force applied by the air cylinders and the internal pressure developed within the attenuation chamber 24. Other clamping means than the air cylinder may be used, such as a spring(s), deformation of an elastic material, or cams; but the air cylinder offers a desired control and variability.

Many alternatives are available to cause or allow a desired movement of the processing chamber wall(s). For example, instead of relying on fluid pressure to force the wall(s) of the processing chamber apart, a sensor within the chamber (e.g., a laser or thermal sensor detecting buildup on the walls or plugging of the chamber) may be used to activate a servomechanical mechanism that separates the wall(s) and then returns them to their steady-state position. In another useful apparatus of the invention, one or both of the attenuator sides or chamber walls is driven in an oscillating pattern, e.g., by a servomechanical, vibratory or ultrasonic driving device. The rate of oscillation can vary within wide ranges, including, for example, at least rates of 5,000 cycles per minute to 60,000 cycles per second.

In still another variation, the movement means for both separating the walls and returning them to their steady-state position takes the form simply of a difference between the fluid pressure within the processing chamber and the ambient pressure acting on the exterior of the chamber walls. More specifically, during steady-state operation, the pressure within the processing chamber (a summation of the various forces acting within the processing chamber established, for example, by the internal shape of the processing chamber, the presence, location and design of air knives, the velocity of a fluid stream entering the chamber, etc.) is in balance with the ambient pressure acting on the outside of the chamber walls. If the pressure within the chamber increases because of a perturbation of the fiber-forming process, one or both of the chamber walls moves away from the other wall until the perturbation ends, whereupon pressure within the processing chamber is reduced to a level less than the steady-state pressure (because the gap width between the chamber walls is greater than at the steady-state operation). Thereupon, the ambient pressure acting on the outside of the chamber walls forces the chamber wall(s) back until the pressure within the chamber is in balance with the ambient pressure, and steady-state operation occurs. Lack of control over the apparatus and processing parameters can make sole reliance on pressure differences a less desired option.

In sum, besides being instantaneously movable and in some cases "floating," the wall(s) of the processing chamber are also generally subject to means for causing them to move in a desired way. The walls can be thought of as generally connected, e.g., physically or operationally, to means for causing a desired movement of the walls. The movement means may be any feature of the processing chamber or associated apparatus, or an operating condition, or a combination thereof that causes the intended movement of the movable chamber walls—movement apart, e.g., to prevent or alleviate a perturbation in the fiber-forming process, and movement together, e.g., to establish or return the chamber to steady-state operation.

In the embodiment illustrated in FIGS. 1-3, the gap width 33 of the attenuation chamber 24 is interrelated with the pressure existing within the chamber, or with the fluid flow rate through the chamber and the fluid temperature. The clamping force matches the pressure within the attenuation chamber and varies depending on the gap width of the attenuation chamber: for a given fluid flow rate, the narrower the gap width, the higher the pressure within the attenuation chamber, and the higher must be the clamping force. Lower clamping forces allow a wider gap width. Mechanical stops, e.g., abutting structure on one or both of the attenuator sides 16*a* and 16*b* may be used to assure that minimum or maximum gap widths are maintained.

In one useful arrangement, the air cylinder 43*a* applies a larger clamping force than the cylinder 43*b*, e.g., by use in cylinder 43*a* of a piston of larger diameter than used in cylinder 43*b*. This difference in force establishes the attenuator side 16*b* as the side that tends to move most readily when a perturbation occurs during operation. The difference in force is about equal to and compensates for the frictional forces resisting movement of the bearings 38 on the rods 39. Limiting means can be attached to the larger air cylinder 43*a* to limit movement of the attenuator side 16*a* toward the attenuator side 16*b*. One illustrative limiting means, as shown in FIG. 3, uses as the air cylinder 43*a* a double-rod air cylinder, in which the second rod 46 is threaded, extends through a mounting plate 47, and carries a nut 48 which may be adjusted to adjust the position of the air cylinder. Adjustment of the limiting means, e.g., by turning the nut 48, positions the attenuation chamber 24 into alignment with the extrusion head 10.

Because of the described instantaneous separation and reclosing of the attenuator sides 16*a* and 16*b*, the operating parameters for a fiber-forming operation are expanded. Some conditions that would previously make the process inoperable—e.g., because they would lead to filament breakage requiring shutdown for rethreading—become acceptable; upon filament breakage, rethreading of the incoming filament end generally occurs automatically. For example, higher velocities that lead to frequent filament breakage may be used. Similarly, narrow gap widths, which cause the air knives to be more focused and to impart more force and greater velocity on filaments passing through the attenuator, may be used. Or filaments may be introduced into the attenuation chamber in a more molten condition, thereby allowing greater control over fiber properties, because the danger of plugging the attenuation chamber is reduced. The attenuator may be moved closer to or further from the extrusion head to control among other things the temperature of the filaments when they enter the attenuation chamber.

Although the chamber walls of the attenuator 16 are shown as generally monolithic structures, they can also take the form of an assemblage of individual parts each mounted for the described instantaneous or floating movement. The individual parts comprising one wall engage one another through sealing means so as to maintain the internal pressure within the processing chamber 24. In a different arrangement, flexible sheets of a material such as rubber or plastic form the walls of the processing chamber 24, whereby the chamber can deform locally upon a localized increase in pressure (e.g., because of a plugging caused by breaking of a single filament or group of filaments). A series or grid of biasing means may engage the segmented or flexible wall; sufficient biasing means are used to respond to localized deformations and to bias a deformed portion of the wall back to its undeformed position. Alternatively, a series or grid of oscillating means may engage the flexible wall and oscillate local areas of the wall. Or, in the manner discussed above, a difference between the fluid pressure within the processing chamber and the ambient pressure acting on the wall or localized portion of the wall may be used to cause opening of a portion of the wall(s), e.g., during a process perturbation, and to return the wall(s) to the undeformed or steady-state position, e.g., when the perturbation ends. Fluid pressure may also be controlled to cause a continuing state of oscillation of a flexible or segmented wall.

As will be seen, in the preferred embodiment of processing chamber illustrated in FIGS. 2 and 3, there are no sidewalls at the ends of the transverse length of the chamber. The result is that fibers passing through the chamber can spread outwardly outside the chamber as they approach the exit of the chamber. Such a spreading can be desirable to widen the mass of fibers collected on the collector. In other embodiments, the processing chamber does include side walls, though a single side wall at one transverse end of the chamber is not attached to both chamber sides 16*a* and 16*b*, because attachment to both chamber sides would prevent separation of the sides as discussed above. Instead, a sidewall(s) may be attached to one chamber side and move with that side when and if it moves in response to changes of pressure within the passage. In other embodiments, the side walls are divided, with one portion attached to one chamber side, and the other portion attached to the other chamber side, with the sidewall portions preferably overlapping if it is desired to confine the stream of processed fibers within the processing chamber.

While apparatus as shown, in which the walls are instantaneously movable, are much preferred, the invention can also be run—generally with less convenience and efficiency—with apparatus such as shown except that the walls defining the processing chamber are fixed in position.

A wide variety of elastic-fiber-forming materials, preferably elastomeric-fiber-forming materials, may be used to make fibrous webs of the invention. Organic polymeric materials that can satisfy the definitions of elastic and elastomeric fibers stated above, in at least some forms (e.g., in at least some molecular structures or molecular weights, or with appropriate co-monomers or other additives) include urethane-based polymers, ethylene-based polymers and propylene-based polymers, ethylene-styrene copolymers, ultra-low-density polyethylene or ultra-low-density polypropylene, ethylene-propylene copolymers and ethylene-propylene block copolymers, styrenic block copolymers, aliphatic polyesters and aliphatic polyamides. Some polymers or materials that are more difficult to form into fibers by spunbond or meltblown techniques can be used.

In the case of semicrystalline polymeric materials, preferred embodiments of the invention provide nonwoven fibrous webs comprising chain-extended crystalline structure (also called strain-induced crystallization) in the fibers, thereby increasing strength and stability of the web (chain-extended crystallization, as well as other kinds of crystallization, typically can be detected by X-ray analysis). Combination of that structure with autogenous bonds, sometimes circumference-penetrating bonds, is a further advantage. The fibers of the web can be rather uniform in diameter over most of their length and independent from other fibers to obtain webs having desired loft properties. Lofts of 90 percent (the inverse of solidity and comprising the ratio of the volume of the air in a web to the total volume of the web multiplied by 100) or more can be obtained and are useful for many purposes such as filtration or insulation. Even the less-oriented fiber segments preferably have undergone some orientation that enhances fiber strength along the full length of the fiber. Other fiber-forming materials that are not crystalline, e.g., styrenic block copolymers, can still benefit from orientation.

While the invention is particularly useful with fiber-forming materials in molten form, other fiber-forming liquids such as solutions or suspensions may also be used. The specific polymers listed above are examples only, and a wide variety of other polymeric or fiber-forming materials are useful. Interestingly, fiber-forming processes of the invention using molten polymers can often be performed at lower temperatures than traditional direct extrusion techniques, which offers a number of advantages.

Fibers also may be formed from blends of materials, including materials into which certain additives have been blended, such as pigments or dyes. The term "fiber" is used herein to mean a monocomponent fiber; a bicomponent or conjugate fiber (for convenience, the term "bicomponent" will often be used to mean fibers that consist of two components as well as fibers that consist of more than two components); and a fiber section of a bicomponent fiber, i.e., a section occupying part of the cross-section of and extending over the length of the bicomponent fiber. Core-sheath or side-by-side bicomponent fibers, may be prepared. In bicomponent fibers of the invention, at least one of the components satisfies the description of an elastic or elastomeric fiber stated above; preferably all components of the fiber satisfy those descriptions.

In addition, different fiber-forming materials may be extruded through different orifices of the extrusion head so as to prepare webs that comprise a mixture of fibers. In other embodiments of the invention other materials are introduced into a stream of fibers prepared according to the invention before or as the fibers are collected so as to prepare a blended web. For example, other staple fibers may be blended in the manner taught in U.S. Pat. No. 4,118,531; or particulate material may be introduced and captured within the web in the manner taught in U.S. Pat. No. 3,971,373; or microwebs as taught in U.S. Pat. No. 4,813,948 may be blended into the webs. Alternatively, fibers prepared according to the present invention may be introduced into a stream of other fibers to prepare a blend of fibers.

Besides the retained orientation of elastic fibers discussed above, webs and fibers of the invention can exhibit other unique characteristics. As one example, a new web of the invention preferably comprises fibers that vary in morphology over their length so as to provide longitudinal segments that differ from one another in softening characteristics during a selected bonding operation (this characteristic is also described in U.S. Pat. No. 6,916,752 and U.S. Publication No. 2003/0216099, which are incorporated herein by reference). Some of these longitudinal segments soften under the conditions of the bonding operation, i.e., are active during the selected bonding operation and become bonded to other fibers of the web; and others of the segments are passive during the bonding operation. Preferably, the active longitudinal segments soften sufficiently under useful bonding conditions, e.g., at a temperature low enough, that the web can be autogenously bonded. Preferably, also, adjacent longitudinal segments differ in diameter by no more than about 10 percent. Thus, the fibers can have a "uniform diameter," by which it is meant herein that the fibers have essentially the same diameter (varying by 10 percent or less) over a significant length (i.e., 5 centimeters or more)).

With respect to block copolymers, it may be noted that the individual blocks of the copolymers may vary in morphology, as when one block is crystalline or semicrystalline and the other block is amorphous; the variation in morphology often exhibited by fibers of the invention is not such a variation, but instead is a more macro property in which several molecules participate in forming a generally physically identifiable portion of a fiber.

While adjacent longitudinal segments may not differ greatly in diameter in webs of the invention, there may be significant variation in diameter from fiber to fiber.

As another unique characteristic of fibers and webs of the invention, in some collected webs fibers are found that are interrupted, i.e., are broken, or entangled with themselves or other fibers, or otherwise deformed as by engaging a wall of the processing chamber. The fiber segments at the location of the interruption—i.e., the fiber segments at the point of a fiber break, and the fiber segments in which an entanglement or deformation occurs—are all termed an interrupting fiber segment herein, or more commonly for shorthand purposes, are often simply termed "fiber ends": these interrupting fiber segments form the terminus or end of an unaffected length of fiber, even though in the case of entanglements or deformations there often is no actual break or severing of the fiber. Such interrupting fiber segments are described in greater detail in issued U.S. Pat. No. 6,607,624, which is incorporated herein by reference.

The fiber ends have a fiber form (as opposed to a globular shape as sometimes obtained in meltblowing or other previous methods) but are usually enlarged in diameter over the medial or intermediate portions of the fiber; usually they are less than 300 micrometers in diameter. Often, the fiber ends, especially broken ends, have a curly or spiral shape, which causes the ends to entangle with themselves or other fibers. And the fiber ends may be bonded side-by-side with other fibers, e.g., by autogenous coalescing of material of the fiber end with material of an adjacent fiber.

Webs of the invention may be coherent upon collection, or steps may be taken after collection to make them coherent or increase their coherency. Such steps include bonding between fibers, including thermal bonding, adhesive bonding with added adhesive or bonding fibers, or mechanical bonding such as achieved by entanglement such as hydroentangling. The basic operating procedure of hydroenetangling is described in, for example, U.S. Pat. No. 5,389,202, issued Feb. 14, 1995, to Everhart et al. (see for example columns 8 and 9), the contents of which are incorporated herein by reference.

Considering the bonding aspects of the invention, the invention can be understood as a method for preparing a fibrous web comprising 1) preparing extruded filaments from an elastic-fiber-forming liquid, 2) processing and attenuating the extruded filaments to solid collectible fibers having molecular orientation, 3) collecting the fibers as a nonwoven web, 4) annealing the collected fibers by exposing them to a temperature that is above their shrinking temperature but less than their relaxation temperature to make the web dimensionally stable while retaining sufficient molecular orientation that the fibers exhibit a birefringence of at least $1\times10^{-5}$, and 5) bonding the fibers (thermally, mechanically, or otherwise) to give the web increased coherency. The steps need not be in the order listed; for example, step (4) could follow step (5).

Figure 4A:
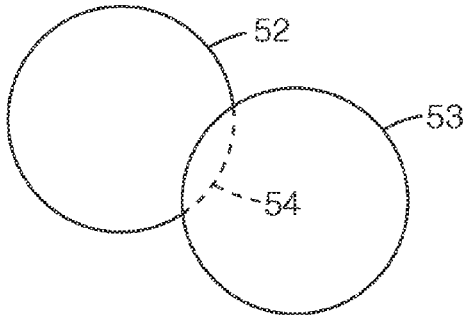
FIGS. 4*a*, 4*b*, and 4*c* are schematic diagrams through illustrative fiber bonds in webs of the invention.
Figure 4B:
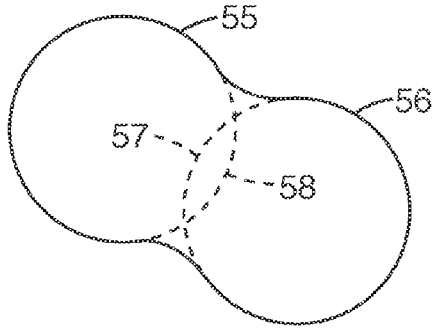
Figure 4C:
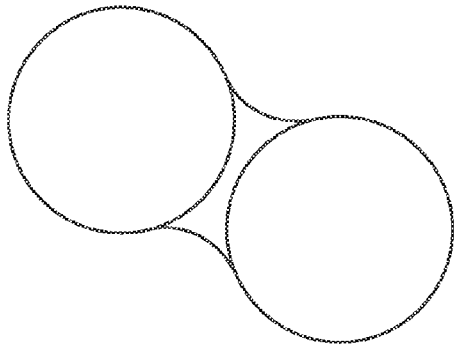
Figure 5:
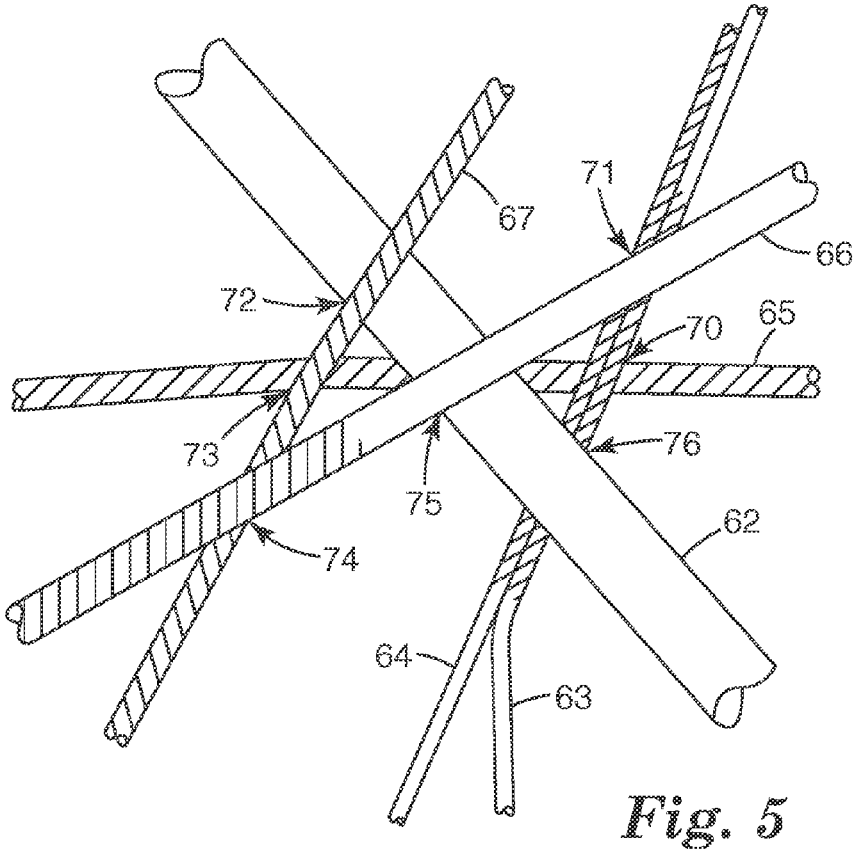
FIG. 5 is a schematic diagram of a portion of a web of the invention, showing fibers crossing over and bonded to one another.

In thermal bonding, the best bonds are obtained when the bonding portion of a fiber flows sufficiently to form a circumference-penetrating type of bond as illustrated in the schematic diagrams FIGS. 4*a* and 4*b*. Such bonds develop more extensive contact between bonded fibers, and the increased area of contact increases the strength of the bond. FIG. 4*a* illustrates a bond in which one fiber or segment 52 deforms while another fiber or segment 53 essentially retains its cross-sectional shape. FIG. 4*b* illustrates a bond in which two fibers 55 and 56 are bonded and each deforms in cross-sectional shape. In both FIGS. 4*a* and 4*b*, circumference-penetrating bonds are shown: the dotted line 54 in FIG. 4*a* shows the shape the fiber 52 would have except for the deformation caused by penetration of the fiber 53; and the dotted lines 57 and 58 in FIG. 4*b* show the shapes the fibers 56 and 55, respectively, would have except for the bond. FIG. 4*c* schematically illustrates two fibers bonded together in a bond that may be different from a circumference-penetrating bond, in which material from exterior portions (e.g., a concentric portion or portions) of one or more of the fibers has coalesced to join the two fibers together without actually penetrating the circumference of either of the fibers.

The bonds pictured in FIGS. 4*a*-4*c* can be autogenous bonds, e.g., obtained by heating a web of the invention without application of calendering pressure. Such bonds allow softer hand to the web and greater retention of loft under pressure. However, pressure bonds as in point-bonding or area-wide calendering are also useful. Bonds can also be formed by application of infrared, laser, ultrasonic or other energy forms that thermally or otherwise activate bonding between fibers. Solvent application may also be used. Webs can exhibit both autogenous bonds and pressure-formed bonds, as when the web is subjected only to limited pressure that is instrumental in only some of the bonds. Webs having autogenous bonds are regarded as autogenously bonded herein, even if other kinds of pressure-formed bonds are also present in limited amounts. In general, in practicing the invention a bonding operation is desirably selected that allows some longitudinal segments to soften and be active in bonding to an adjacent fiber or portion of a fiber, while other longitudinal segments remain passive or inactive in achieving bonds.

The invention is particularly useful as a direct-web-formation process in which a fiber-forming polymeric material is converted into a web in one essentially direct operation (including extrusion of filaments, processing and solidifying of the filaments, collection of the processed filaments, and, if needed, further processing to transform the collected mass into a web). Nonwoven fibrous webs of the invention preferably comprise directly collected fibers or directly collected masses of fibers, meaning that the fibers are collected as a web-like mass as they leave the fiber-forming apparatus. Other components such as staple fibers or particles or other directly formed fibers can be collected together with the mass of directly formed fibers of the invention.

The average diameter of fibers prepared according to the invention may range widely. Microfiber sizes (about 10 micrometers or less in diameter) may be obtained and offer several benefits; but fibers of larger diameter can also be prepared and are useful for certain applications; often the fibers are 20 micrometers or less in diameter. Fibers of circular cross-section are most often prepared, but other cross-sectional shapes may also be used. Depending on the operating parameters chosen, the collected fibers may be rather continuous or essentially discontinuous.

As indicated above, according to the invention filaments are processed at fast velocities. For example, polypropylene is not known to have been processed at apparent filament speeds of 8000 meters per minute through a processing chamber, but such apparent filament speeds are possible with apparatus as shown in FIGS. 1-3 (the term apparent filament speed is used, because the speeds are calculated, e.g., from polymer flow rate, polymer density, and average fiber diameter). A filament speed of 2800 meters/minute or higher has been found to provide advantages in the present invention; generally we prefer to operate at a filament speed of at least 4000 or 5000 meters per minute. Even faster apparent filament speeds have been achieved on apparatus as shown in FIGS. 1-3, e.g., 10,000 meters per minute, or even 14,000 or 18,000 meters per minute, and these speeds can be obtained with a wide range of polymers.

In addition, large volumes of polymer can be processed per orifice in the extrusion head, and these large volumes can be processed while at the same time moving extruded filaments at high velocity. This combination gives rise to a high productivity index—the rate of polymer throughput (e.g., in grams per orifice per minute) multiplied by the apparent velocity of extruded filaments (e.g., in meters per minute). The process of the invention can be readily practiced with a productivity index of 9000 or higher, even while producing filaments that average 20 micrometers or less in diameter.

Figure 6:
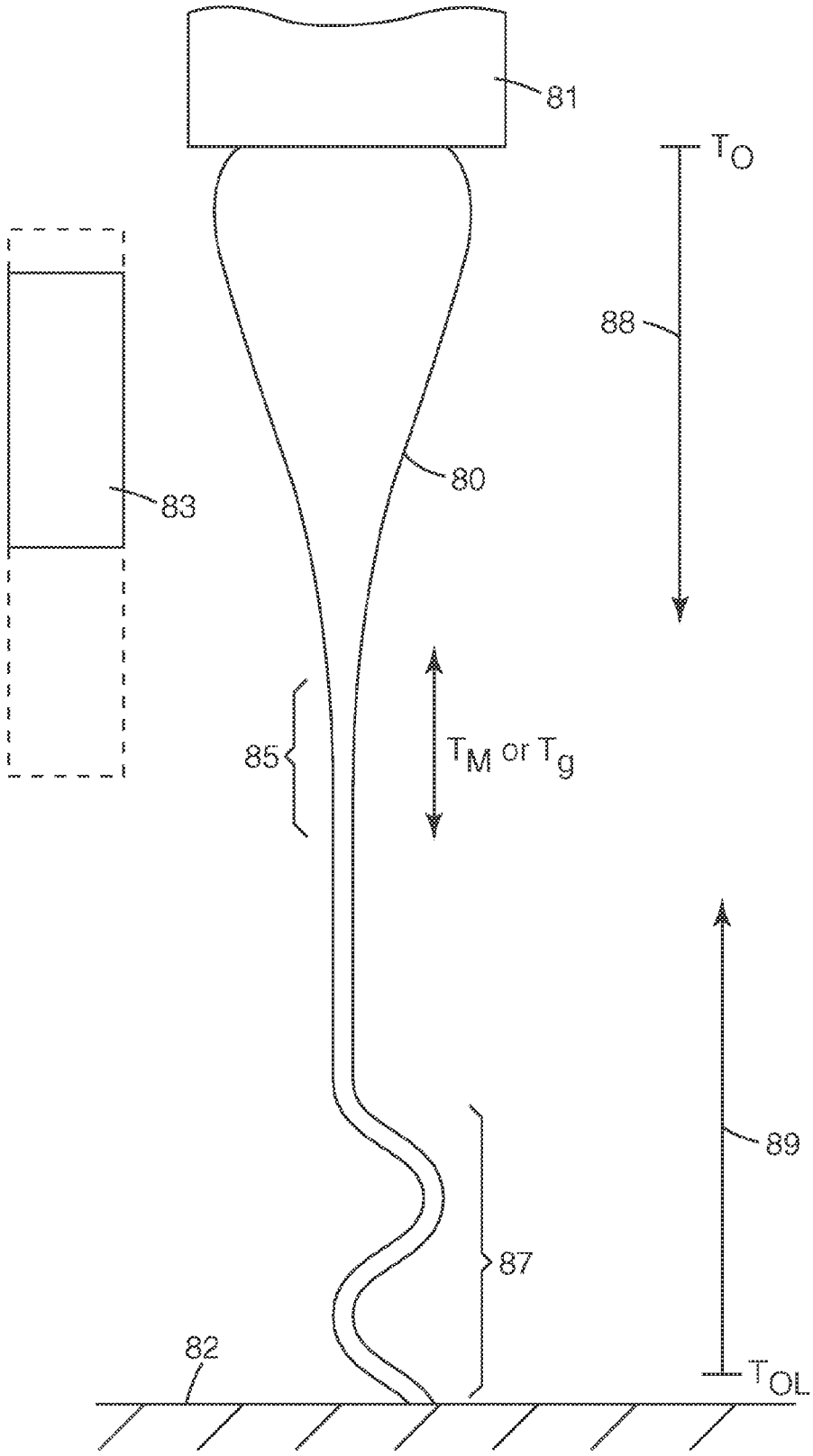
FIGS. 6 and 7 are schematic diagrams showing an illustrative extruded filament extending from extrusion head to collector, with accompanying illustrative apparatus and descriptive information.
Figure 7:
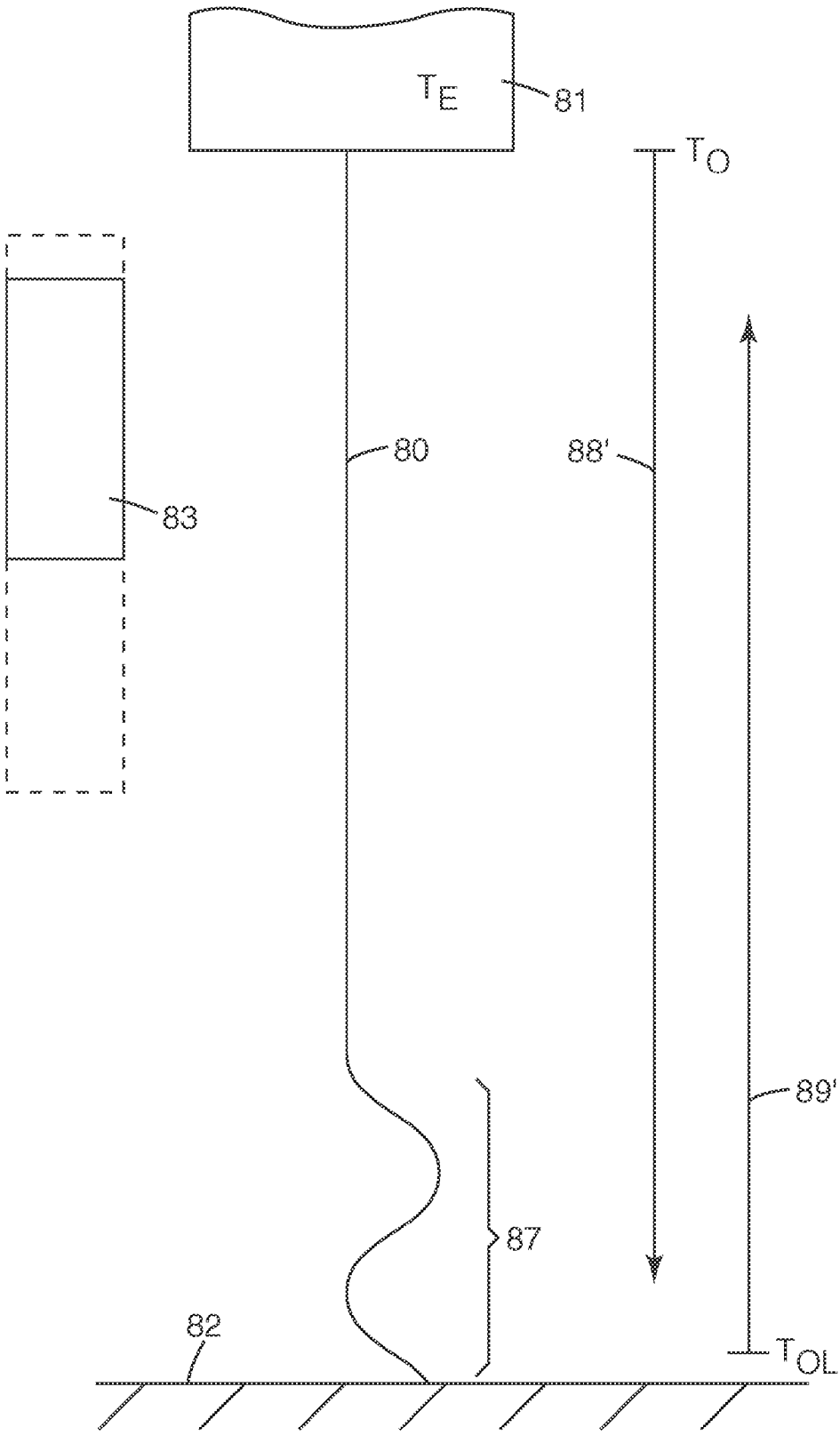

FIGS. 6 and 7 illustrate some of the terminology and concepts involved in the invention. FIG. 6 is a schematic diagram of a typical extruded filament 80 prepared from a molten fiber-forming material and processed into a fiber according to the invention; the figure shows the filament as it is processed and changes dimensions, but does not show the filament actually passing through attenuating or other apparatus. Dimensions in the schematic diagram are greatly enlarged and not intended to accurately represent true dimensions.

As shown in FIG. 6, the filament is extruded from an extrusion head 81 and travels to a collector 82. The filament passes through a processing chamber, but for purposes of illustration, the processing chamber 83 is drawn at extremely small scale in comparison to the filament and placed at the side of the threadline (rather than in its normal position on the threadline).

When the molten filament 80 leaves the extrusion head 81, it typically swells in size because of its release from the confines of the extrusion orifice. Then it narrows in diameter because of drawing forces applied to it, e.g., the pull of air blown threw the processing chamber. The extruded filament continues to narrow in diameter as it moves further away from the extrusion head and toward the collector, during which time the filament is cooling—e.g., because cooler air such as ambient or quenching streams of air or other gas typically surrounds the fiber. Narrowing in diameter continues essentially until the filament reaches the solidification/melting temperature of the filamentary material (for crystalline or semicrystalline materials) or the glass transition temperature (for amorphous materials); the location where the filament reaches the solidification/melting temperature or the glass transition temperature is marked on the threadline as a region 85, as well as by a bar marked $T_m/T_g$ to represent that this region need not be a precise point but typically will extend for a distance along the threadline. From the region 85 onward toward the collector the filament can essentially retain its diameter; some narrowing can continue if the drawing forces applied to the filament are large enough.

According to the invention the relative positions of the region 85 and the processing chamber 83 can be varied. One illustrative position for the processing chamber is shown in solid lines, but the processing chamber can also occupy different positions within a range suggested by dotted lines; the dotted lines are not intended to fully describe or exhaust the possible positions of the processing chamber. In other words, the extruded filament 80 can reach a temperature corresponding to $T_m$ or $T_g$ before it reaches the processing chamber, while it is in the processing chamber, or after it leaves the processing chamber.

After the extruded filament leaves the processing chamber it generally travels through a region of turbulence. Turbulence occurs as the currents passing through the processing chamber reach the unconfined space at the end of the chamber, where the pressure that existed within the chamber is released. The current stream widens as it exits the chamber, and eddies develop within the widened stream. These eddies—whirlpools of currents running in different directions from the main stream—subject the filament to forces different from the straight-line forces the filament is subjected to within the chamber and before reaching the chamber. For example, the filament can undergo a to-and-fro flapping, illustrated at 87, and be subjected to forces that have a vector component transverse to the length of the filament. The forces applied in a turbulent field past the processing chamber may be the strongest experienced by an extruded filament during travel from an extrusion head to a collector.

FIG. 6 also schematically shows typical ranges of positions along the threadline where the filament may be at its orientation temperature or orientation-locking temperature assuming $T_m$ or $T_g$ is in the position shown. As shown in FIG. 6 the filament can generally be at orienting temperature within the range of positions represented by the line 88, when $T_m$ or $T_g$ is in the position shown. And the filament can generally achieve the orientation-locking temperature within the range of positions represented by the line 89, when $T_m$ or $T_g$ is in the position shown.

FIG. 7 is another schematic diagram, showing filament 80 without identifying a particular region where the filament reaches $T_m$ or $T_g$. The intention of this diagram is to show that an extruded filament can be at the orienting temperature or the orientation-locking temperature at a variety of distances from the extruder. As shown in FIG. 7 the range of positions at which the filament remains at the orienting temperature, shown by the line 88', can extend from the extrusion head 81 (where the filament-forming material is at a temperature ($T_E$) that is typically 30-40° C. above $T_m$ or $T_g$) to a position near the collector. And conversely, the range of positions at which the filament reaches the orientation-locking temperature, represented by the line 89', can extend from a position near the collector 82 to a position before (upstream of) the processing chamber 83.

Various processes conventionally used as adjuncts to fiber-forming processes may be used in connection with filaments as they enter or exit from the attenuator, such as spraying of finishes or other materials onto the filaments, application of an electrostatic charge to the filaments, application of water mists, etc. In addition, various materials may be added to a collected web, including bonding agents, adhesives, finishes, and other webs or films.

Although there typically is no reason to do so, filaments may be blown from the extrusion head by a primary gaseous stream in the manner of that used in conventional meltblowing operations. Such primary gaseous streams cause an initial attenuation and drawing of the filaments.

EXAMPLES 1-4

Apparatus as shown in FIGS. 1-3 was used to prepare four different fibrous webs. Two of the webs, Examples 1 and 2, were formed from a polyurethane resin (PS440-200 supplied by Huntsman Polyurethanes of Salt Lake City, Utah, having a melt flow rate of 25 g/10 min.). The polyurethane was heated to 221° C. in the extruder (temperature measured in the extruder 12 near the exit to the pump 13), and the die was heated to a temperature as listed in Table 1 below.

The other two webs, Examples 3 and 4, were formed from an ultra-low-density polyethylene resin (Engage 8411 available from Dupont-Dow Elastomers, Wilmington Del., which includes 33% octene as a co-monomer (percentages are weight percents unless otherwise indicated) and has a melt index of 18 g/10 minute). The polyethylene was heated to 271° C. in the extruder (temperature measured in the extruder 12 near the exit to the pump 13), and the die was heated to a temperature as listed in Table 1 below.

In all four examples the extrusion head or die had 16 rows of orifices; in Examples 1 and 2 each row had 32 orifices, making a total of 512 orifices; in Examples 3 and 4 each row had 16 orifices, making a total of 256 orifices. The die had a transverse length of 7.875 inches (200 millimeters). The hole diameter was 0.040 inch (0.889 mm) and the L/D ratio was 6. The polymer flow rate was 0.89 g/hole/minute and 0.98 g/hole/minute in Examples 3 and 4.

The distance between the die and attenuator (dimension 17 in FIG. 1) was 37 inches (about 94 centimeters), and the distance from the attenuator to the collector (dimension 21 in FIG. 1) was 26.75 inches (68 centimeters). The air knife gap (the dimension 30 in FIG. 2) was 0.030 inch (0.76 millimeter); the attenuator body angle ($\alpha$ in FIG. 2) was 30°; room temperature air was passed through the attenuator; and the length of the attenuator chute (dimension 35 in FIG. 2) was 6 inches (152 millimeters). The air knife had a transverse length (the direction of the length 25 of the slot in FIG. 3) of about 251 millimeters; and the attenuator body 28 in which the recess for the air knife was formed had a transverse length of about 330 millimeters. The transverse length of the wall 36 attached to the attenuator body was 14 inches (406 millimeters).

Other attenuator parameters were as described in Table 1 (below at the end of the examples), including the gaps at the top and bottom of the attenuator (the dimensions 33 and 34, respectively, in FIG. 2); the total volume of air passed through the attenuator (given in actual cubic meters per minute, or ACMM; about half of the listed volume was passed through each air knife 32); and filament speed (apparent). Clamping pressure on the walls of the attenuator was about 500 kilopascals in Examples 1 and 2 and about 550 kilopascals in Examples 3 and 4, both of which pressures tended to hold the walls against movement during the process.

The webs of Examples 1 and 2 were subjected to annealing by passing them under a hot air knife set at 95 degrees C. for an exposure time of 0.11 second with a face velocity of 21 meters per second with a slot width (the machine-direction dimension) of 1.5 inches (3.8 centimeters).

The webs of Examples 3 and 4 were subjected to annealing by passing them under a hot air knife set at 90 degrees C. for an exposure time of 0.19 second with a face velocity of 19 meters per second and a slot width of 1.5 inches (3.8 centimeters).

Optical examinations including birefringence studies using a polarized microscope were performed on the prepared webs (after annealing) to examine the degree of orientation within the fibers of the webs, and the results are reported in Table 2 (at the end of the examples). The birefringence of the fibers was measured using a Nikon Eclipse E600 polarized microscope manufactured by Nikon Instruments Inc, 1300 Walt Whitman Road, Melville, N.Y. The Berek compensator technique outlined by Berek Compensator Instructions, Nichika Corporation, Japan, Revision Aug. 10, 2001, was used in making the measurements. A protocol for the measurement is as follows: Carefully align the microscope to center objectives, optics, condenser and light source. Place the fiber to be measured in the center of the view field. Rotate the stage to the extinction position closest to North-South alignment in the view field. Rotate the sample 45 degrees counterclockwise. Using the Berek compensator turn the drum clockwise until the black band appears in the center of the fiber. Note the reading in degrees. Using the Berek compensator, turn the drum counterclockwise until the black band appears in the center of the fiber. Note the reading in degrees. The inclination is the difference between the readings divided by two.

The retardation value may be obtained from a table provided by the manufacturer or by calculation knowing the machine constant; for Examples 1-4, the calculation equation is $R=10000\,F_{(i)}$ multiplied by C/10000, where $F_{(i)}$ is obtained from a table provided by the manufacturer and C/10000 is 1.009. The diameter of the fiber is then measured at the point where the birefringence was measured and birefringence is calculated from retardation divided by diameter. Values were reported as an average of a minimum of ten readings of representative single fibers.

In a subsequent bonding step, the webs of Examples 3 and 4 were heat sealed using a two-roll calender. The calender settings were as follows:

Top Roll—

Point Bond Diamond pattern with a 20% bond area

Points have a 1 mm×1 mm land area.

22 inches (56 cm) wide (along the axis of the drum) with an outer diameter of 10 inches (25.4 cm)

Temperature of oil in roll=155° F. (68 degrees C.)

Speed of web 5 feet per minute (1.52 meters per minute)

Bottom Roll—

Smooth Steel 22 inches (56 cm) wide (along the axis of the drum) with an outer diameter of 10 inches (25.4 cm)

Temperature of oil in roll=155° F. (68° C.)

Speed of web 5 feet per minute (1.52 meters per minute)

Nip Pressure—100 psi (689 kPa)

Tensile tests were performed on samples of the webs with an Instron Model 5544 tensile testing machine. Three machine-direction samples (sample cut from the web in the same direction that the fibers were made) and three cross-direction samples were tested using a 10-inch (25.4 centimeter)/minute crosshead speed, a 2-inch (5.08-centimeter) jaw gap, and sample strips cut to 1×4 inches (2.54 by 5.08 centimeter). When similar samples are stretched to 200% their original length and released, they quickly (within seconds) recover to less than 125% their original length.

| Example | Tensile Strength (Newtons) | Average Tensile Strain (Percent) |
|---|---|---|
| 1 | 4.4 | 680 |
| 2 | 4.73 | 780 |
| 3 | 4.9 | 350 |
| 4 | 5.8 | 368 |

EXAMPLES 5 and 6

Apparatus as shown in FIGS. 1-3 was used to prepare two different fibrous webs from blends of diblock polymers and other components. Example 5 used a blend of 60% of a styrenic block copolymer (Kraton® D1119P available from Kraton® Polymers Houston Tex., consisting of about 34% SIS copolymer and about 66% SI diblock with about 22% styrene content) and 40% mineral oil (Chevron Superla® White Oil 31 available from Chevron Texaco Corporation Midland Tex.). The blend was heated to 253 degrees C. in the extruder (temperature measured in the extruder 12 near the exit to the pump 13), and the die was heated to a temperature as listed in Table 1 below.

Example 6 used a blend consisting of 90% of a different styrenic block copolymer (Kraton® RP 6936 available from Kraton® Polymers Houston Tex.) and 10% of a paraffin oil ("Paraffin Prills Purified," available from J. T. Baker, Phillipsburg, N.J.). The blend was heated to 241 degrees C. in the extruder (temperature measured in the extruder 12 near the exit to the pump 13), and the die was heated to a temperature as listed in Table 1 below.

The extrusion head or die had two rows of orifices, and each row had 16 orifices, making a total of 32 orifices. The die had a transverse length of 4.125 inches (104.8 millimeters). The hole diameter was 0.040 inch (0.889 mm) and the L/D ratio was 6. The polymer flow rate was 0.87 g/hole/minute for both examples.

The distance between the die and attenuator (dimension 17 in FIG. 1) was 2.7 inches (about 6.8 centimeters), and the distance from the attenuator to the collector (dimension 21 in FIG. 1) was 22 inches (59 centimeters). The air knife gap (the dimension 30 in FIG. 2) was 0.050 inch (0.1.3 millimeter); the attenuator body angle ($\alpha$ in FIG. 2) was 30°; room temperature air was passed through the attenuator; and the length of the attenuator chute (dimension 35 in FIG. 2) was 3 inches (76 millimeters). The air knife had a transverse length (the direction of the length 25 of the slot in FIG. 3) of about 121 millimeters; and the attenuator body 28 in which the recess for the air knife was formed had a transverse length of about 156 millimeters. The transverse length of the wall 36 attached to the attenuator body was 10 inches (254 millimeters).

Other attenuator parameters were also varied as described in Table 1 including the gaps at the top and bottom of the attenuator (the dimensions 33 and 34, respectively, in FIG. 2); and the total volume of air passed through the attenuator (given in actual cubic meters per minute, or ACMM; about half of the listed volume was passed through each air knife 32). No clamping pressure was applied to the walls of the attenuator, so the walls were free to move under the force of air pressure.

For Examples 5 and 6, samples were held in a constant temperature oven for 5 minutes at 70 degrees C. and returned to room temperature before measurements were taken.

Optical examinations including birefringence studies using a polarized microscope were performed on the prepared webs (after annealing) to examine the degree of orientation within the fibers of the webs, and the results are reported in Table 2 (at the end of the examples).

EXAMPLE 7

Apparatus as shown in FIGS. 1-3 was used to prepare webs from an elastomeric polyethylene-based resin (Engage 8402 (22% octene comonomer content) available from Dupont-Dow Elastomers Wilmington Del.). The resin was heated to 240° C. in the extruder (temperature measured in the extruder 12 near the exit to the pump 13), and the die was heated to a temperature as listed in Table 1 below. The extrusion head or die had 16 rows of orifices, and each row had 32 orifices, making a total of 512 orifices. The die had a transverse length of 8.0 inches (20.3 millimeters). The hole diameter was 0.040 inch (0.889 mm) and the L/D ratio was 6. The polymer flow rate was 0.5 g/hole/minute.

The distance between the die and attenuator (dimension 17 in FIG. 1) was 44 inches (about 112 centimeters), and the distance from the attenuator to the collector (dimension 21 in FIG. 1) was 37.5 inches (92 centimeters). The air knife gap (the dimension 30 in FIG. 2) was 0.050 inch (0.1.27 millimeter); the attenuator body angle (α in FIG. 2) was 30°; room temperature air was passed through the attenuator; and the length of the attenuator chute (dimension 35 in FIG. 2) was 6 inches (152 millimeters). The air knife had a transverse length (the direction of the length 25 of the slot in FIG. 3) of about 251 millimeters; and the attenuator body 28 in which the recess for the air knife was formed had a transverse length of about 330 millimeters. The transverse length of the wall 36 attached to the attenuator body was 14 inches (406 millimeters). The clamping pressure on the walls of the processing chamber was 900 kiloPascal, which held the walls against movement during the process.

Other attenuator parameters were also varied as described in Table 1, including the gaps at the top and bottom of the attenuator (the dimensions 33 and 34, respectively, in FIG. 2); and the total volume of air passed through the attenuator (given in actual cubic meters per minute, or ACMM; about half of the listed volume was passed through each air knife 32).

The collected batt of Example 7 was hydroentangled with a conventional hydraulic entangling system consisting of 6 manifolds/jets (three above and three below the web). The basic operating procedure is described in, for example, U.S. Pat. No. 5,389,202, issued Feb. 14, 1995, to Everhart et al. (see for example columns 8 and 9), the contents of which are incorporated herein by reference. Each manifold had an orifice size of 120 microns diameter. Orifices were positioned in a single row at a spacing of about 16 orifices per linear centimeter of manifold. Manifold water pressure was successively ramped up to 10,000 kPa which generated high energy fine columnar jets. The hydraulic entangling surface was a single layer 100 stainless steel twill wire backing manufactured by Albany International, Portland, Tenn. The hydraulic entangling surface was a single-layer standard-weave 14×13 polyester netting with 28 percent open-area manufactured by Albany International, Portland, Tenn. The material of Example 7 was passed under the manifolds at a line speed of about 5 meters per minute where they were washed and consolidated by the pressurized jets of water. The resulting composite web was dried utilizing a conventional laboratory handsheet dryer at 80 degrees C. to dry and anneal the sample. Though shrinking of fibers occurred during the annealing step, the web remained as an integral well-formed sheet material, and was an elastic, soft and dimensionally stable material after annealing was completed.

Optical examinations including birefringence studies using a polarized microscope were performed on the prepared webs (after annealing) to examine the degree of orientation within the fibers of the webs, and the results are reported in Table 2 (at the end of the examples).

TABLE 1

| Example No. | Die Temperature (° C.) | Attenuator Gap Top (mm) | Attenuator Gap Bottom (mm) | Attenuator Air Flow (ACMM) | Air Pressure kPa | Filament Speed (meters/minute) |
|---|---|---|---|---|---|---|
| 1 | 220 | 5.1 | 5.0 | 3.8 | 120 | 3600 |
| 2 | 220 | 5.1 | 5.0 | 3.1 | 81 | 7000 |
| 3 | 270 | 5.1 | 5.0 | 3.1 | 81 | 4500 |
| 4 | 270 | 5.1 | 5.0 | 4.8 | 136 | 9000 |
| 5 | 254 | 8 | 8 | 2.5 | 141 | 6800 |
| 6 | 260 | 10 | 10 | 0.8 | 35 | 5200 |
| 7 | 250 | 7.5 | 7.1 | 8.9 | 136 | 5300 |

TABLE 2

| Example | Fiber Diameter (μm) | Birefringence | Fiber's Color Seen Through Polarized Microscope |
|---|---|---|---|
| 1 | 13.25 | 0.050 | Peach-Red-Blue |
| 2 | 17 | 0.040 | Orange-Blue |
| 3 | 16 | 0.031 | Gray-Amber |
| 4 | 11 | 0.040 | Gray-Amber |
| 5 | 32.3 | 0.0052 | Gray |
| 6 | 21.5 | 0.0016 | Gray |
| 7 | 11.6 | 0.037 | Gray-Amber |

What is claimed is:

1. A fiber-forming method comprising a) extruding filaments of elastomeric-fiber-forming material; b) directing the filaments through a processing chamber in which a longitudinal stress is applied to the filaments that attenuates and draws the filaments; c) maintaining the filaments at their orienting temperature while the filaments are under attenuating and drawing stress for a sufficient time for molecules within the filaments to become oriented along the length of the filaments; d) cooling the filaments to their orientation-locking temperature after said molecules have been oriented along the length of the filaments and while the filaments are under attenuating and drawing stress; and further cooling the filaments to solidified elastomeric fibers that may be stretched to at least twice their original length and, when released from tension stretching them to twice their original length, will promptly retract to no more than one-and-one-fourth times their original length; e) collecting the solidified elastomeric fibers as a fibrous nonwoven web; and f) annealing the collected fibers by exposing them to a temperature that is above the shrinking temperature of the fibers but less than the relaxation temperature of the fibers.

2. A method of claim 1 in which the filaments enter the processing chamber at a temperature higher than the glass transition temperature or melting point of the filaments.

3. A method of claim 1 in which the largest longitudinal stress is applied to the filaments after they leave the processing chamber.

4. A method of claim 2 in which the largest longitudinal stress is applied to the filaments after they leave the processing chamber.

5. A method of claim 1 in which the filaments pass through the processing chamber at a rate of at least 2800 meters/minute.

6. A method of claim 2 in which the filaments pass through the processing chamber at a rate of at least 2800 meters/minute.

7. A method of claim 4 in which the filaments pass through the processing chamber at a rate of at least 2800 meters/minute.

8. A method of claim 1 in which the filaments pass through the processing chamber at a rate of at least 4000 meters/minute.

9. A method of claim 1 including the further step of thermally bonding the fibers after they have been annealed.

10. A method of claim 1 in which the filaments comprise an ethylene-based polymer or a propylene-based polymer.

11. A method of claim 1 in which the filaments comprise a urethane-based polymer.

12. A method of claim 1 in which the filaments comprise a styrenic block copolymer.

13. A method of claim 1 in which the filaments comprise an aliphatic polyester or an aliphatic polyamide.

14. A method of claim 1 further comprising bonding the collected web to give it increased coherency after step (e), wherein annealing the collected fibers in step (f) makes the web dimensionally stable while retaining sufficient molecular orientation that the fibers exhibit a birefringence of at least $1\times10^{-5}$.

15. A method of claim 14 in which step (f) is performed after bonding the collected web to give it increased coherency.

16. A method of claim 14 in which bonding of the collected web to give it increased coherency comprises hydroentangling the web.

17. A method of claim 14 in which bonding of the collected web to give it increased coherency comprises thermally bonding the collected fibers after they have been annealed in step (f).

18. A method of claim 17 in which bonding of the collected web to give it increased coherency by thermally bonding the fibers after they have been annealed in step (f) comprises forming autogenous bonds.

19. A method of claim 14 in which the filaments are processed and attenuated by passing the filaments through the processing chamber at a rate of at least 2800 meters/minute.

20. A method of claim 14 in which the fibers retain sufficient molecular orientation after annealing to exhibit a birefringence of at least $1\times10^{-2}$.

* * * * *